United States Patent [19]

Harrison

[11] Patent Number: 4,662,013

[45] Date of Patent: May 5, 1987

[54] FITTED CONTOUR SHEET FOR MATTRESSES

[76] Inventor: Sandra K. Harrison, 48 E. New York, Pontiac, Mich. 48055

[21] Appl. No.: 797,165

[22] Filed: Nov. 12, 1985

[51] Int. Cl.[4] ..... A47G 9/04

[52] U.S. Cl. ..... 5/497; 5/498

[58] Field of Search ..... 5/494–501; 273/13; 297/219, 224

[56] References Cited

U.S. PATENT DOCUMENTS

| | | | |
|---|---|---|---|
| 2,214,074 | 9/1940 | Clarke | 5/499 |
| 2,454,463 | 11/1948 | Kromer et al. . | |
| 2,662,234 | 12/1953 | Citron | 5/495 |
| 2,791,784 | 5/1957 | Tomsic . | |
| 2,857,643 | 10/1958 | Tomsic | 5/496 |
| 3,148,388 | 9/1964 | Espersen | 5/497 |
| 3,181,179 | 5/1965 | Roddey, Jr. | 5/497 |
| 3,273,175 | 9/1986 | Anderson et al. . | |
| 3,962,739 | 6/1976 | Crockett . | |
| 4,045,831 | 9/1977 | Clark . | |
| 4,161,044 | 7/1979 | Bogle | 5/494 |

*Primary Examiner*—Gary L. Smith
*Assistant Examiner*—Michael F. Trettel
*Attorney, Agent, or Firm*—Gifford, Groh, VanOphem, Sheridan, Sprinkle and Dolgorukov

[57] ABSTRACT

A fitted contour sheet or mattress cover which includes additional elastic members for retaining the corners of the cover upon the mattress. The additional elastic includes elastic bands which extend diagonally across each corner of the sheet and an elastic band which extends from the diagonal elastic to the corner of the sheet. The present invention therefore prevents inadvertant removal of the sheet due to extensive wear or excessive motion.

9 Claims, 2 Drawing Figures

FITTED CONTOUR SHEET FOR MATTRESSES

BACKGROUND OF THE INVENTION

I. Field of the Invention

This invention relates to fitted covers for mattresses and, in particular, to a fitted sheet which has additional elastic members for retaining the ends of the sheet over the corners of the mattress.

II. Description of the Prior Art

Contoured or fitted sheets for mattresses are well known to hold the sheet in place upon the mattress while eliminating wrinkles. Generally, contour sheets include a fabric body with end and side portions which are joined along a common edge to conform the sheet to the shape of the mattress. In order to properly retain the sheet upon the mattress, an elastic material may be secured to the edge of the sheet. In most instances, the elastic is sewn in the corners of the sheets such that the corners are maintained beneath the mattress. However, the elastic may be provided along the entire edge of the sheet in order to draw the edges of the sheet together beneath the mattress. In either prior known embodiment, the sheet is maintained on the mattress by the limited size of the opening formed by the edge of the sheet drawn together by the elastic.

However, repeated removal, washing and replacement of the fitted sheet causes the elastic to lose its elastic properties. This can cause the sheet to lose its contour and to be inadvertently removed from the mattress during normal use. Moreover, the simple elastic provided on the prior known fitted sheets is incapable of properly retaining the sheet on oversized or non-conventional mattresses such as waterbed mattresses which are subject to constant movement due to the fluid motion of the mattress.

SUMMARY OF THE PRESENT INVENTION

The present invention provides a fitted contour cover for mattresses which overcomes the disadvantages of the previously known fitted covers.

The sheet according to the present invention comprises a fabric body having end and side portions which form the sides of the sheet. The end and side portions are joined along their common edge thereby forming corners of the sheet. An elastic fabric is sewn into the edge of the sheet in order to draw the edges together beneath the mattress. In order to provide additional retention beneath the mattress, a pair of elastic bands are secured to each corner of the sheet. The first elastic band extends diagonally across the corner and is secured at its ends to a side and an end portion of the sheet. The second elastic band extends from the midpoint of the first elastic band to the edge of the sheet thereby bisecting the corner formed by the side and end portions of the sheet.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
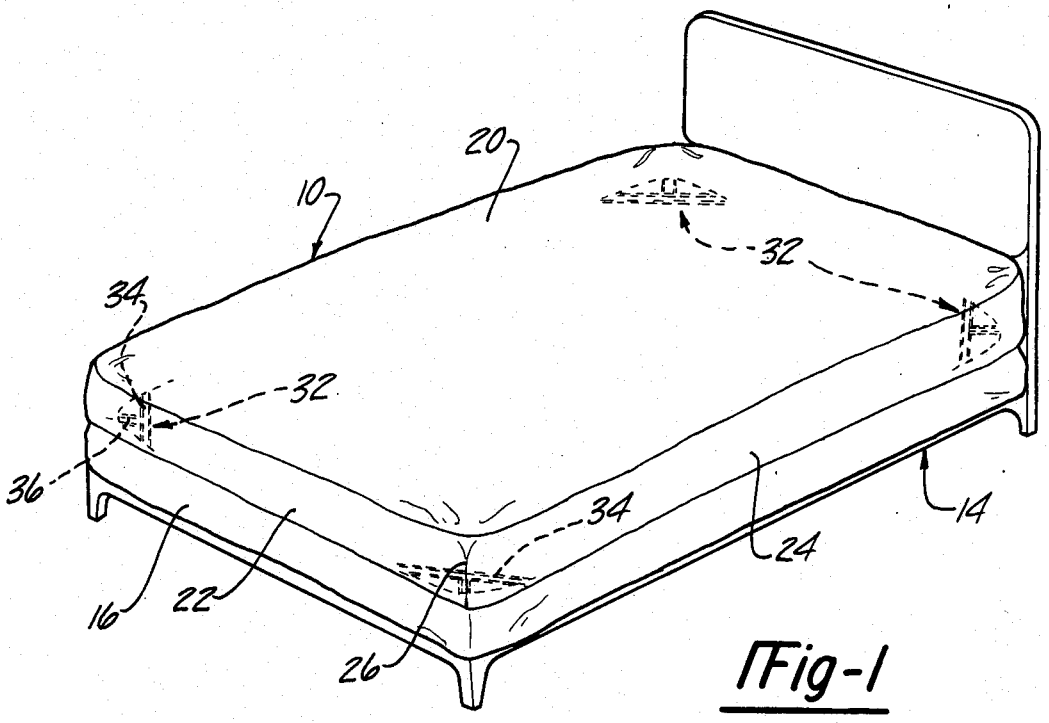
FIG. 1 is an elevated perspective view of the bed sheet of the present invention mounted to a mattress with the corners of the sheet shown in phantom.
Figure 2:
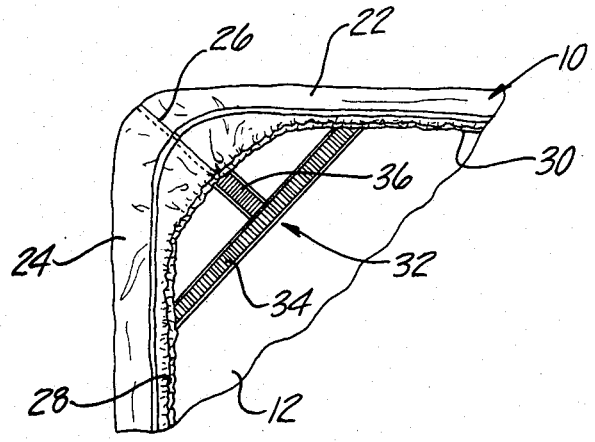
FIG. 2 is a partial bottom plan view of the bed sheet mounted to a mattress.

Referring generally to FIGS. 1 and 2 a fitted contour sheet 10 embodying the present invention is thereshown mounted to a mattress 12 of a bed 14. It is to be understood that the bed 14 and mattress 12 may be any size with the sheet 10 sized accordingly. In addition, although the present invention is described in connection with a conventional spring mattress 12, the sheet 10 may be utilized on a mattress of any shape or construction including a water bed mattress.

The fitted sheet 10 of the present invention generally comprises a fabric body 20 having end portions 22 and side portions 24. As with prior known sheets, the end and side portions 22 and 24 are joined along a common edge seam 26 in order to contour the sheet 10 to the rectangular shape of the mattress 12.

Referring now to FIG. 2, in order to maintain the sheet 10 over the mattress 12, corner elastic 28 is secured to the outer edge 30 of the body 20 of the sheet 10. Generally, the elastic 28 is included only in the corner portions formed by the end and side portions 22 and 24 of the sheet 10. However, this elastic may extend along the entire outer edge 30 of the sheet 10. The elastic 28 is utilized to draw the corners of the body 20 towards the center of the mattress 12 in order to maintain the sheet 10 over the corners of the mattress 12. In addition, the elastic 28 allows the opening formed by the edge 30 of the sheet 10 to be enlarged so that the sheet 10 may be conveniently mounted over the corners of the mattress 12.

In addition to the corner elastic 28 found on the prior known mattress sheets, the present invention includes additional elastic means 32 for retaining the sheet 10 over the mattress 12. The elastic means 32 extends across each corner of the sheet 10, as is best seen in FIG. 2, and generally comprises a first elastic member 34 and a second elastic member 36. The first elastic member 34 extends diagonally across a corner of the sheet 10 and is connected at one end to the end portion 22 of the body 20 and at its other end to the side portion 24 of the body 20. Preferably, the ends of the first elastic member 34 are secured to the edge 30 although attachment of the elastic 34 may be accomplished directly to the body 20 of the sheet 10.

The second elastic member 36 extends between the first elastic member 34 and the body 20 of the sheet 10. As is shown in FIG. 2, the second elastic member 36 generally bisects the corner of the sheet 10 and is secured at one end to a midpoint of the first elastic member 34 and, at its other end, to the edge 30 of the sheet 10 in the direct vicinity of the seam 26 where the common edges of the side portion 24 and end portion 22 are joined. Thus, the second elastic member 36 maintains the position of the first elastic member 34 across the corner of the sheet 10. It will be understood that the term bisect as used herein does not necessarily imply equaity of the two sections created.

In the embodiment shown in FIG. 2, the elastic means 32 is made of elastic straps which will lie flat between the mattress 12 and the box spring 16. However, the elastic means 32 may be made of any resilient material capable of providing expansion of the corner of the sheet 10 over the corner of the mattress 12.

Once in position, the elastic means 32 provides additional support for maintaining the sheet 10 on the mattress 12. The sheet 10 is mounted onto the mattress 12 one corner at a time such that the elastic means 32 extends beneath the mattress 12. Because of the resilient properties of the corner elastic 28 and the elastic means 32, the last corner of the sheet 10 is easily mounted over the corner of the mattress 12 by stretching the sheet corner until it will extend beneath the mattress 12. Because of the weight of the mattress 12 and the friction of the elastic means as it extends between the mattress 12 and the box spring 16, the corners of the sheet 10 are prevented from coming off of the mattress 12. This is particularly advantageous on sheets 10 which have been used extensively causing the corner elastic 28 to wear out or break. Thus, the elastic means 32 prevents the sheet 10 from dismounting itself from the mattress 12 thereby prolonging the useful life of the sheet 10.

In addition, the sheet 10 of the present invention may prevent injury to infants or restless adults whose constant movement may cause prior known sheets to dismount from the mattress. Furthermore, the present invention is particularly suited for waterbed mattresses which are subject to extreme and constant movement thereby causing dismounting of the sheet. With the sheet 10, the elastic means 32 can be conveniently pulled beneath the waterbed mattress without requiring lifting of the mattress corner. Once in position, the weight of the water in the mattress will maintain the elastic means 32 beneath the mattress despite the constant motion associated with waterbed mattresses.

Moreover, it is to be understood that although the present invention is described in association with a sheet, the features of the invention can be applied to any type of mattress cover, including a mattress pad which is normally disposed beneath the sheet.

The foregoing detailed description has been given for clearness of understanding only and no unnecessary limitations should be understood therefrom as some modifications will be obvious to those skilled in the art without departing from the scope of the amended claims.

I claim:

1. A fitted contour cover for mattresses, comprising:

a fabric body having end and side portions, said end and side portions joined along a common edge;

corner elastic secured to the outer edges of said body wherein said corner elastic extends along the outer edges of said end and side portions of said body thereby forming a corner of said body; and elastic means extending between said end portions and said side portions of each corner of said body, wherein said elastic means comprises a first elastic member extending diagonally across each corner of said body, one end of said first elastic member being secured to an end portion of said body and the other end being secured to a side portion of said body, and a second elastic member extending between said first elastic member and said fabric body.

2. The mattress cover as defined in claim 1 wherein said second elastic member has one end secured to the midpoint of said first elastic member and its other end secured to the outer edge of the corner of said body wherein said second elastic member bisects said corner of said body.

3. The mattress cover as defined in claim 1 wherein said first and second elastic members comprise elastic bands.

4. A fitted contour cover for mattresses, comprising:

a fabric body having end and side portions, said end and side portions joined along a common edge;

corner elastic secured to the outer edges of said fabric body wherein said corner elastic extends along the outer edges of said end and side portions of said body thereby forming a corner of said body;

first elastic means extending diagonally across each corner of said body, one end of said first elastic means being secured to an end portion of said body and the other end of said first elastic means being secured to a side portion of said body; and second elastic means extending between said first elastic means and said fabric body wherein said second elastic means bisects said corner formed by said end and said side portions of said fabric body.

5. The mattress cover as defined in claim 4 wherein said first elastic means comprises an elastic band having one end secured to the outer edge of an end portion of said body and its other end secured to the outer edge of a side portion of said body wherein said elastic band extends diagonally across a corner of said body.

6. The mattress cover as defined in claim 5 wherein said second elastic means comprises an elastic band having one end secured to the midpoint of said elastic band of said first elastic means and its other end secured to the outer edge of the corner of said body wherein said elastic band substantially bisects said corner of said body.

7. The mattress cover as defined in claim 4 wherein said fabric body has four corners formed by side end and side portions and wherein each corner includes said first and second elastic means.

8. In a fitted contour cover for mattresses in which the cover has a fabric body with end and side portions joined along a common edge forming a corner and corner elastic secured to and extending along the outer edges of the end and side portions of the body, the improvement comprising:

first elastic means extending diagonally across each corner of the body, one end of said first elastic means being secured to an end portion of the body and the other end of said first elastic means being secured to a side portion of the body; and second elastic means extending between said first elastic means and the outer edge of the fabric body wherin said second elastic means bisects the corner formed by the end and side portions of the fabric body.

9. The mattress cover as defined in claim 8 wherein said first and second elastic means comprise elastic bands.

* * * * *